US008188935B2

(12) United States Patent
Saddington et al.

(10) Patent No.: US 8,188,935 B2
(45) Date of Patent: May 29, 2012

(54) ANTENNA DEVICE

(75) Inventors: Stephen Saddington, Vogtareuth (DE); Johann Obermaier, Weiching (DE); Walter Staniszewski, Aschau (DE); Stefan Berger, Rohrdorf (DE)

(73) Assignee: Kathrein-Werke KG, Rosenheim (DE)

( * ) Notice: Subject to any disclaimer, the term of this patent is extended or adjusted under 35 U.S.C. 154(b) by 356 days.

(21) Appl. No.: 12/669,337

(22) PCT Filed: Jun. 12, 2008

(86) PCT No.: PCT/EP2008/004736

§ 371 (c)(1),
(2), (4) Date: Jan. 15, 2010

(87) PCT Pub. No.: WO2009/010135

PCT Pub. Date: Jan. 22, 2009

(65) Prior Publication Data

US 2010/0188310 A1 Jul. 29, 2010

(30) Foreign Application Priority Data

Jul. 19, 2007 (DE) ..... 10 2007 033 817

(51) Int. Cl.
*H01Q 1/42* (2006.01)

(52) U.S. Cl. ..... 343/872; 343/878; 343/880

(58) Field of Classification Search ..... 343/872, 343/878, 880

See application file for complete search history.

(56) References Cited

U.S. PATENT DOCUMENTS

| | | | | |
|---|---|---|---|---|
| 5,844,529 | A | 12/1998 | Bell et al. | |
| 5,896,112 | A | 4/1999 | Bickford et al. | |
| 6,067,053 | A * | 5/2000 | Runyon et al. | 343/797 |
| 7,245,267 | B2 * | 7/2007 | Gottl et al. | 343/872 |

FOREIGN PATENT DOCUMENTS

| | | |
|---|---|---|
| DE | 10 2005 018 052 | 11/2006 |
| EP | 1 601 046 | 11/2005 |
| JP | 11-127016 | 5/1999 |
| WO | 2009/010134 | 1/2009 |

OTHER PUBLICATIONS

International Search Report for PCT/EP2008/004736, mailed Sep. 15, 2008.

* cited by examiner

*Primary Examiner* — Hoang V Nguyen
(74) *Attorney, Agent, or Firm* — Nixon & Vanderhye P.C.

(57) ABSTRACT

An improved antenna device has an internal length compensation device, permitting a varying length expansion of the housing/radome in relation to the antenna support or reflector device located within the housing/radome. At least one of at least two internal fixing devices is provided with the internal length compensation device. The internal length compensation device is in at least two parts or has two limbs, wherein one part is fixed to the antenna support and/or reflector device and the other part is at least indirectly fixed to the housing/radome and/or supported thereby. The at least two parts can be moved relative to each other, be moved in position or deformed. In particular with relation to the support points of both parts, the position may be changed with common deformation.

23 Claims, 8 Drawing Sheets

ANTENNA DEVICE

This application is the U.S. national phase of International Application No. PCT/EP2008/004736 filed 12 Jun. 2008, which designated the U.S. and claims priority to German Application No. DE 10 2007 033 817.3 filed 19 Jul. 2007, the entire contents of each of which are hereby incorporated by reference.

The invention relates to an antenna device, in particular to an antenna device which is in the form of an array and comprises a plurality of rays which are positioned offset with respect to one another at least in one attachment direction, according to the preamble of claim 1.

Antenna devices, particularly for stationary mobile communications stations, are well known.

They generally comprise an antenna device which is usually in the form of an array and also comprises a plurality of radiators which are positioned offset with respect to one another, for example in a vertical direction, and are arranged upstream of a reflector surface. The entire reflector does not necessarily have to be in a vertical position, but can be oriented at a specific angle to the vertical. The entire arrangement is then accommodated in a housing, termed a radome, which appears to be "transparent" or "effectively transparent" to electromagnetic rays.

As is known, for example from EP 1 601 046 A1, antenna devices of this type are usually anchored and mounted on masts or walls etc, by at least two mounting plates or mounting attachments which are positioned offset in the longitudinal direction of the antenna device. The mounting attachments concerned are usually rigidly connected to the housing/radome, or have a fixed continuous connection with the internal supporting structure of the antenna device, for example in the form of the reflector. This is also often easily possible for antennae of this type, as the temperature-induced length expansions with respect to the plastics material used for the radome and the metal parts are in a similar size arrangement and thus no fundamental problems arise here.

Furthermore, DE 10 2005 108 052 A1 for example discloses a method and a production of an antenna cap for submarines, thus for a very specific use.

Mobile communications installations of the type mentioned at the outset not only allow mobile subscribers to have conversations on mobile phones, but also allow users to surf while on the move, for example using GPRS, UMTS via WLAN hotspots and the like.

In addition, so-called WiMAX technology (Worldwide Interoperability for Microwave Access) is becoming increasingly important. Two main applications can be included in this technology. One main application is a stationary radio alternative compared to the DSL fixed network, i.e. an effectively wireless DSL. In another main application, this technology can be described as wide area LAN, i.e. a type of WLAN (Wireless Metropolitan Access).

The essential advantage, particularly in the last-mentioned case, is that the service area, i.e. the coverage area or in general the so-called hotspot of a wireless base station of this type is much wider and also mobile users can surf the Internet, for example, from much greater distances via this base station. A hotspot of this type can serve an area of a few kilometres in diameter and can enable network access in this area, via which speech communication is ultimately also possible. In this case, services and construction of the network are similar to those of a UMTS network.

Although this technology is not fixed or restricted to specific frequency regions, it can generally be stated that an application region above a frequency of 2 GHz is involved, for example in the 2 GHz range but also in the 3.5 GHz range or even in the so-called 5.8 GHz range, etc.

In accordance with the higher frequencies for the preferred field of application, in particular for so-called wireless technology, it emerges with respect to these higher transmission frequencies that the dimensions and in particular the radiators as well and the distances between the radiators are significantly smaller than in the conventional mobile communications ranges, for example in the 900 MHz range, in the 1800 to 1900 MHz range or for example also in the UMTS range of approximately 2.3 GHz. However, it has also now been found that with increasingly higher operating frequencies, the materials which are usually used for the antenna housing, the so-called radome, result in an appreciable weakening of the electromagnetic rays, thus in an undesirable attenuation during passage through a radome of this type. In so doing, the radiation is not only attenuated, but is also scattered. Furthermore, undesirable effects are also possible on the chart itself.

Therefore, other materials are now preferred for the higher frequency ranges in question; thermoplastic polymers are preferred instead of fibre-glass reinforced plastics, for example, as used in conventional radio ranges.

A category-defining antenna device is known from U.S. Pat. No. 5,844,529 A. It comprises a reflector which is covered up by a radome. The radome itself comprises on each of its mutually opposed faces a projecting tongue or projecting profile, with which the radome can be slid into two grooves which are formed on the outwards-pointing face portions of the reflector. The radome is thus held displaceably relative to the reflector.

The antenna device is sealed by two caps which can be attached to opposite end faces of the radome. In doing this, it is provided that one sealing cap is connected rigidly to the radome and to the reflector in such a way that at this end the radome is not held displaceably relative to the reflector. By contrast, the opposing cap, i.e. the cap provided on the lower face of the generally vertically extending antenna arrangement, is only fixed to the radome, in such a way that the radome can carry out a compensation movement relative to the reflector at this point, corresponding to the different thermal expansion coefficients.

Although this does provide some improvement over conventional solutions, the object of the present invention is to provide an antenna which can be used in a straightforward manner, even when the most varied materials are used for the radome, for example thermoplastic polymers.

The object is achieved according to the invention in accordance with the features stated in claim 1. Advantageous embodiments of the invention are provided in the subclaims.

A serious disadvantage of thermoplastic polymers is that they have significantly higher temperature-induced expansion coefficients, which are very different from the expansion coefficients of metals in particular.

If a supporting structure which is generally made of metal, particularly a reflector which extends over almost the entire length or height (or width) of the antenna housing/radome, is accommodated in an antenna housing/radome of this type (for example made of a thermoplastic polymer), highly relevant differing expansions on the antenna housing/radome will be noted compared to the metallic supporting parts and the reflector during the large fluctuations in temperature which are to be considered. With temperature fluctuations to be considered of from −40° to 80° and when the antenna housing/radome is, for example 70 cm in length, this can mean that the radome changes in length by 8 mm compared to the metallic supporting parts. The device itself is usually mounted at room temperature. This means that the radome is shortened or extended by respectively 4 mm, as a result of which in the mentioned example, there is a maximum change in length of 8 mm. Such considerable differences in temperature and expansions in length can ultimately result in damage to or at least impairment of the housing/radome, which can mean in particular that the radome will no longer be impermeable and moisture will be able to penetrate inside the interior, which must be avoided at all costs.

Against this background, the invention provides the possibility of an improved construction which takes these differing temperature-induced expansions into account.

The invention thus provides that an antenna supporting and/or reflector device which is usually supported at two mutually offset points or regions inside a housing/radome is not rigidly connected to the housing/radome, but that in addition to a rigid connection point, at least one mounting device for the antenna supporting and/or reflector device is provided which is equipped with an internal length compensation device.

This internal length compensation device is constructed such that it allows a temperature-induced expansion in length of the housing/radome compared to the antenna supporting and/or reflector device inside the housing/radome.

Due to the solution according to the invention, not only is the antenna supporting device or the reflector held securely without it being possible for a relatively great, temperature-induced change in length of the housing/radome to result in damage or impairment to said housing/radome. The invention further provides an energy storing device which exerts contact forces, directed onto one another, onto the opposing end caps positioned on the opposite end faces of the housing/radome. Consequently, the specific internal mounting device with the length compensation device can ultimately also introduce contact forces, directed onto one another, onto the two opposing end caps such that the end caps are held firmly and securely on the end faces of the housing/radome 1 in a fixed and permanently tight manner for all temperature-induced fluctuations in length of said housing/radome 1, in such a manner that the interior of the housing/radome is protected against environmental influences.

A preferred embodiment also provides an external length compensation device which allows a corresponding antenna device, in particular with a housing/radome, to be fitted to a mast or a housing etc. so that in this case as well, an expansion in length of the housing/radome is possible without impairment or damage, even if the external attachment devices are fitted in a stationary manner.

The invention will be described in the following with reference to drawings for a plurality of embodiments. In the drawings.

Figure 3:
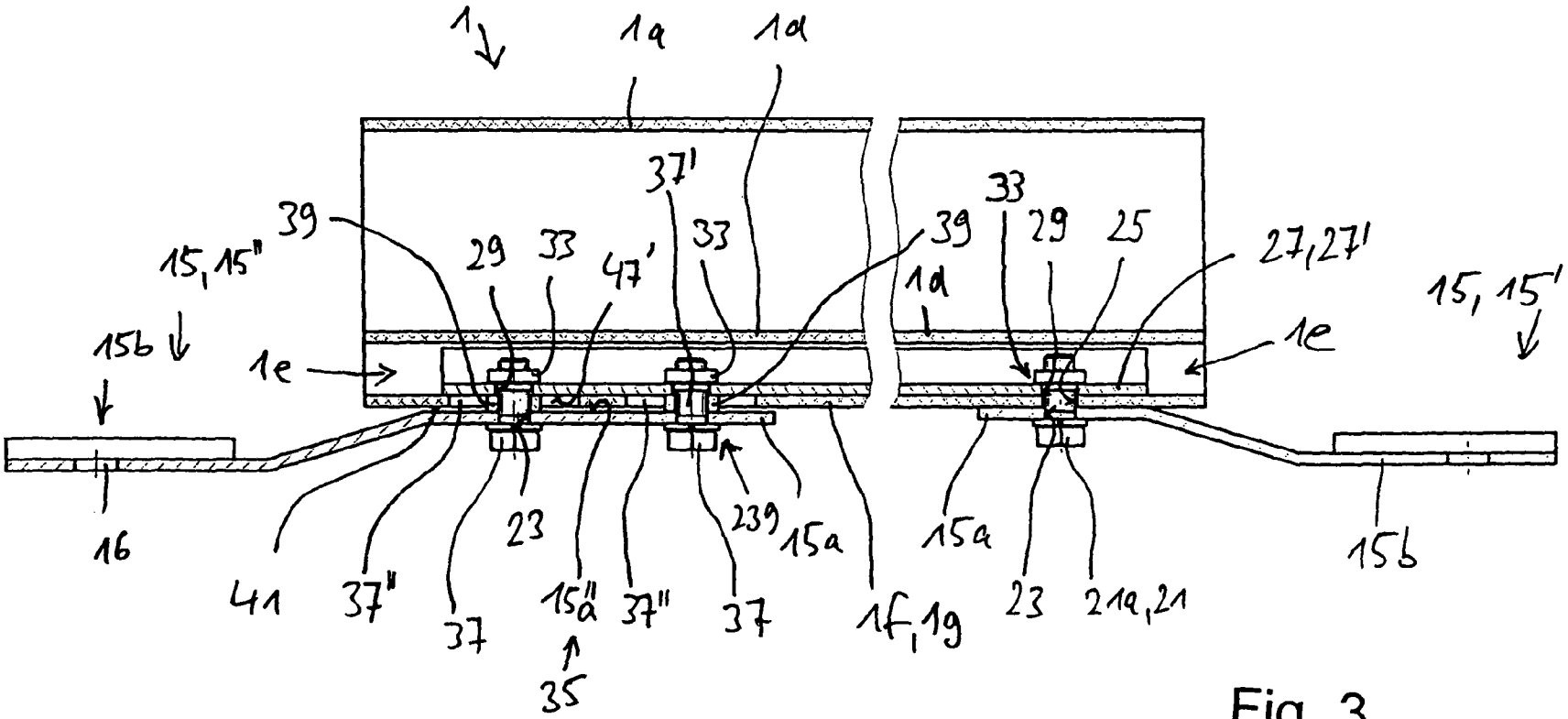
FIG. 3 is a schematic vertical-longitudinal sectional view through the antenna device (without showing the antenna device or the radiators or the reflector and the end face-opposed cover caps) to illustrate the attachment device including a length compensation device.
Figure 3A:
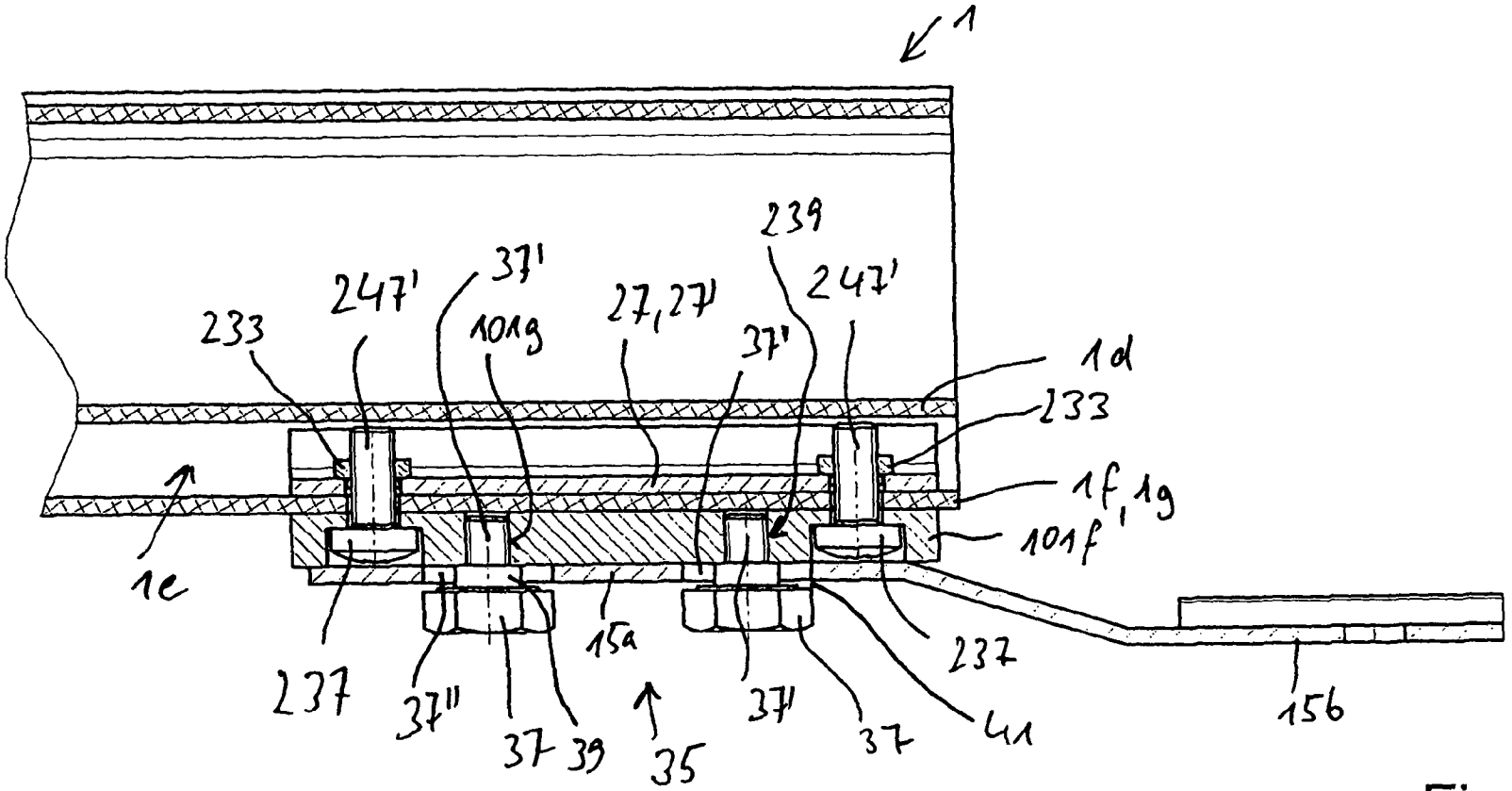
Figure 4:
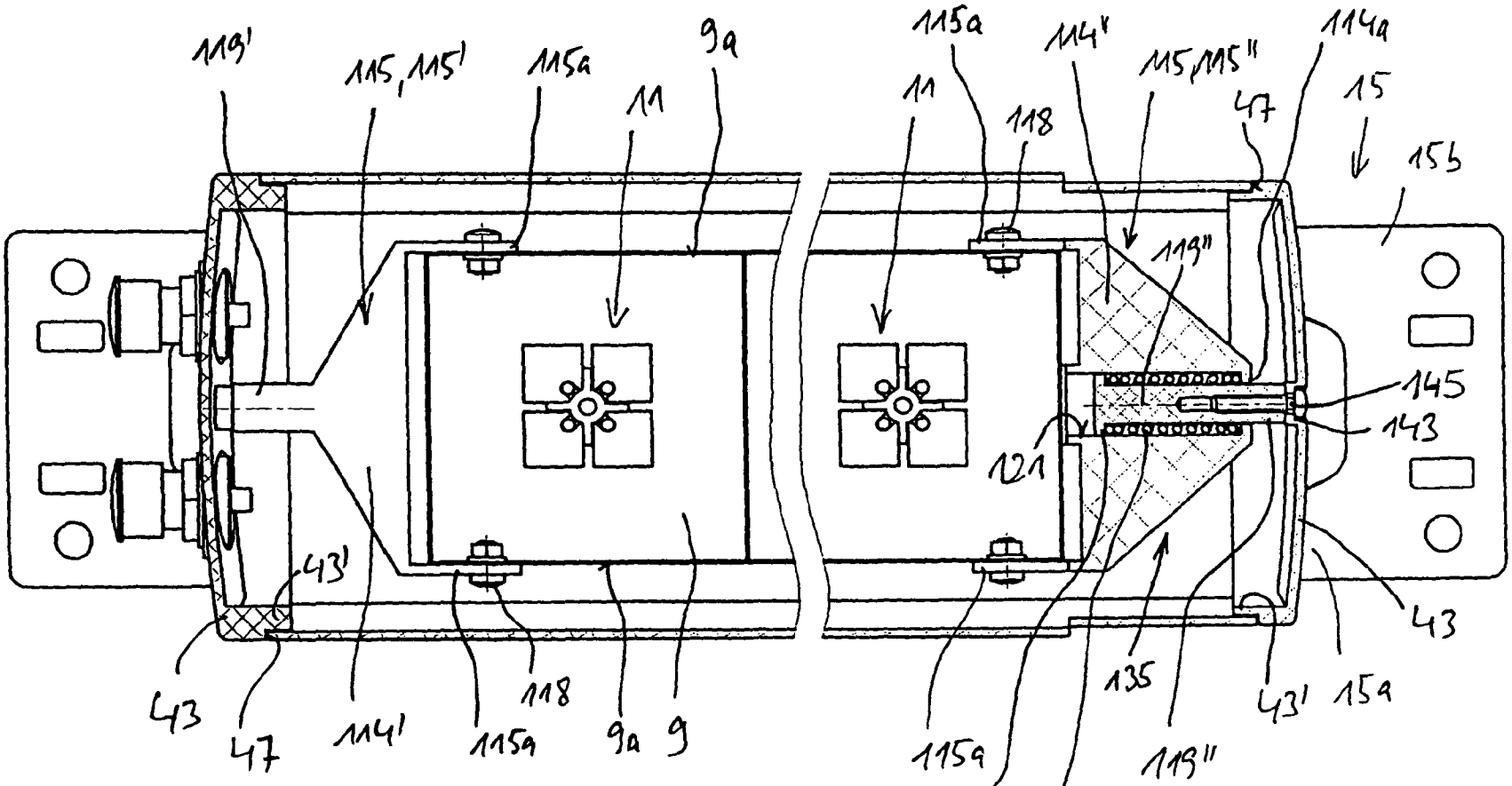
Figure 5:
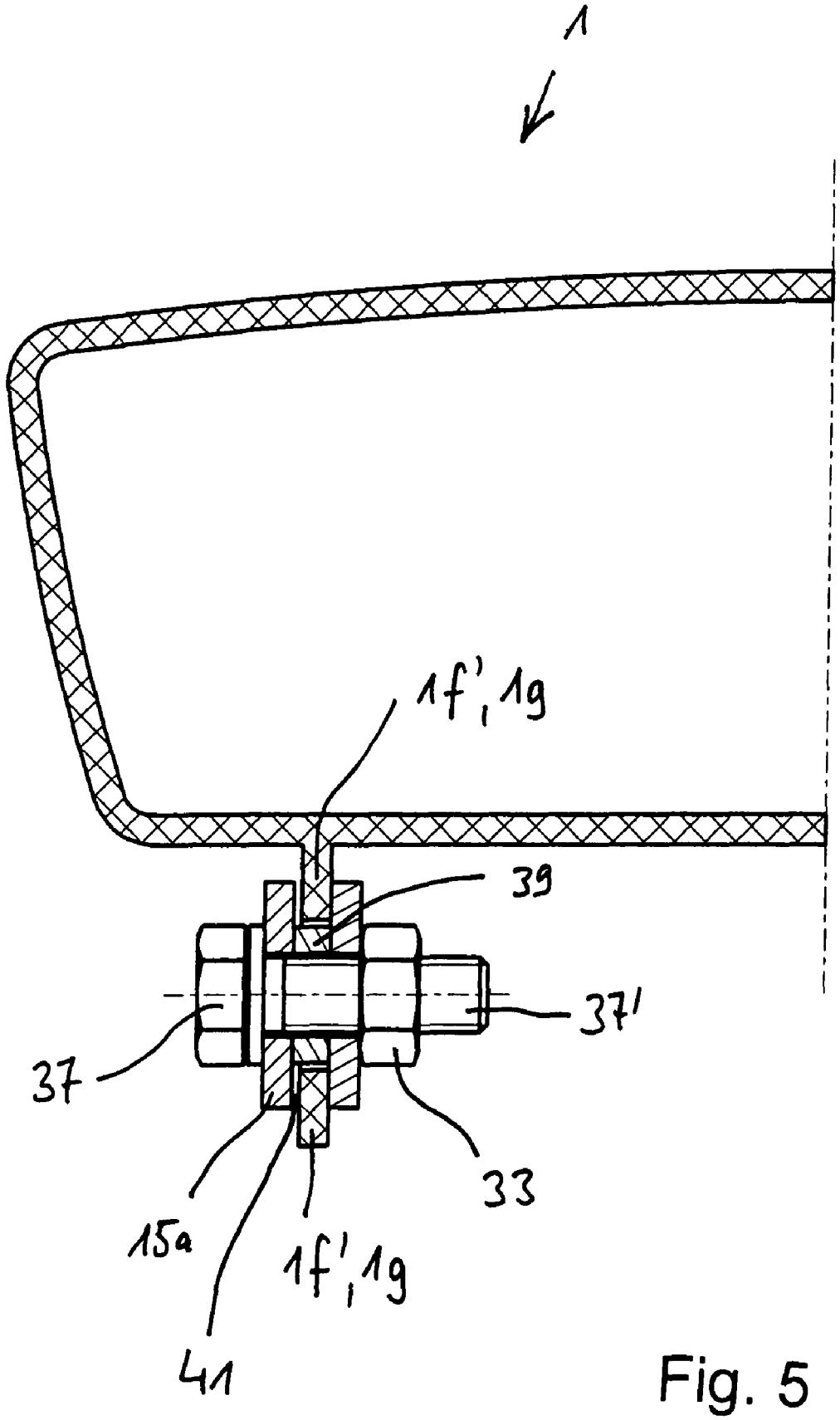
Figure 6:
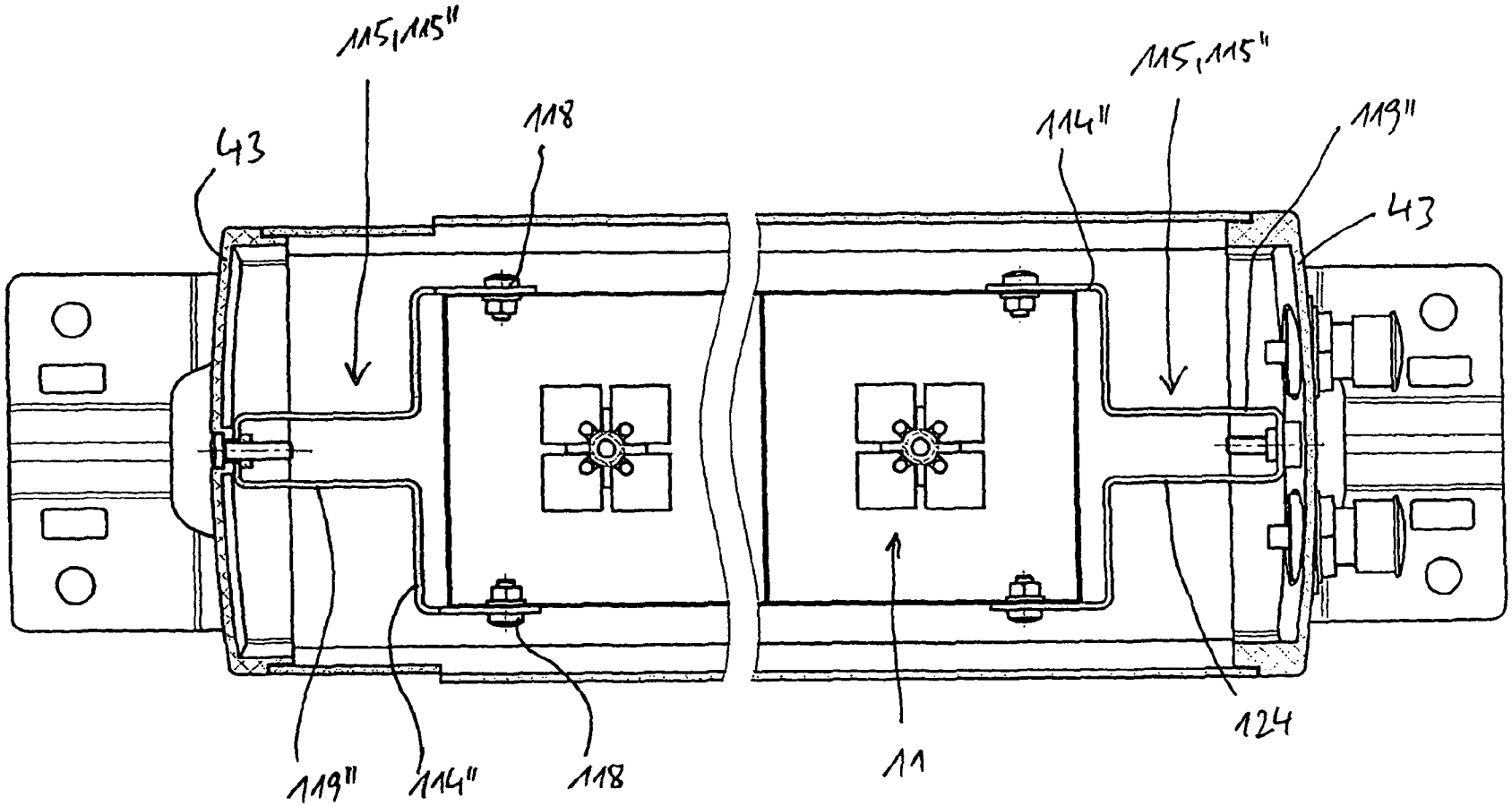
Figure 7:
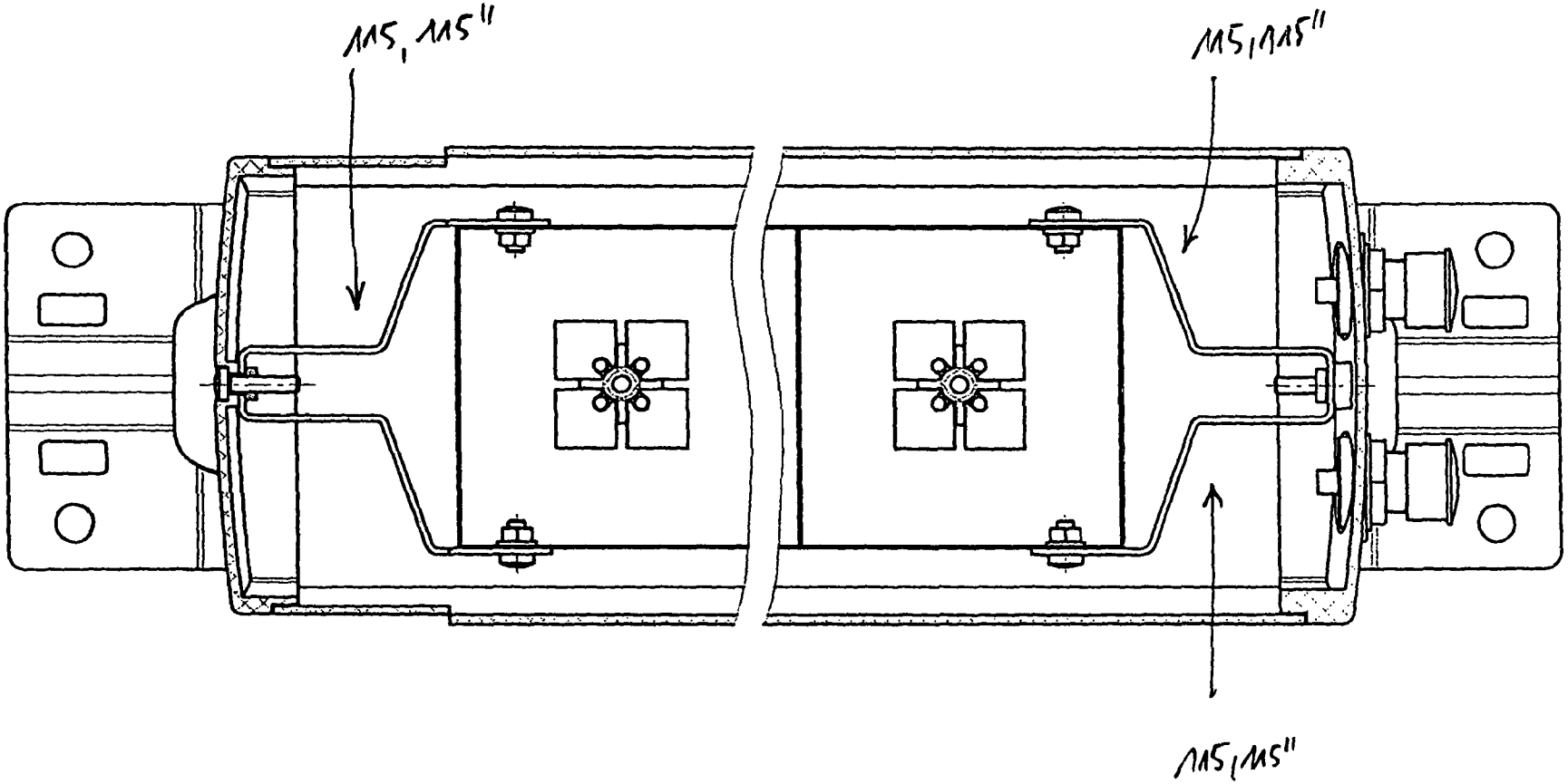

FIG. 3*a* shows a modified embodiment of FIG. 3;

FIG. 4 is a partial plan view of the antenna device, the upper part of the housing/radome having been removed;

FIG. 5 is a schematic cross-sectional view of a selected part of a modified embodiment with a mounting attachment device with length compensation;

FIG. 6 is a schematic plan view of a modified embodiment of an internal mounting device in the form of a deformable spring device in a first loaded state; and FIG. 7 is a view corresponding to that of FIG. 6 in another loaded state with a differing temperature-induced length expansion of the housing/radome with respect to the internal supporting and/or radome device.

Figure 1:
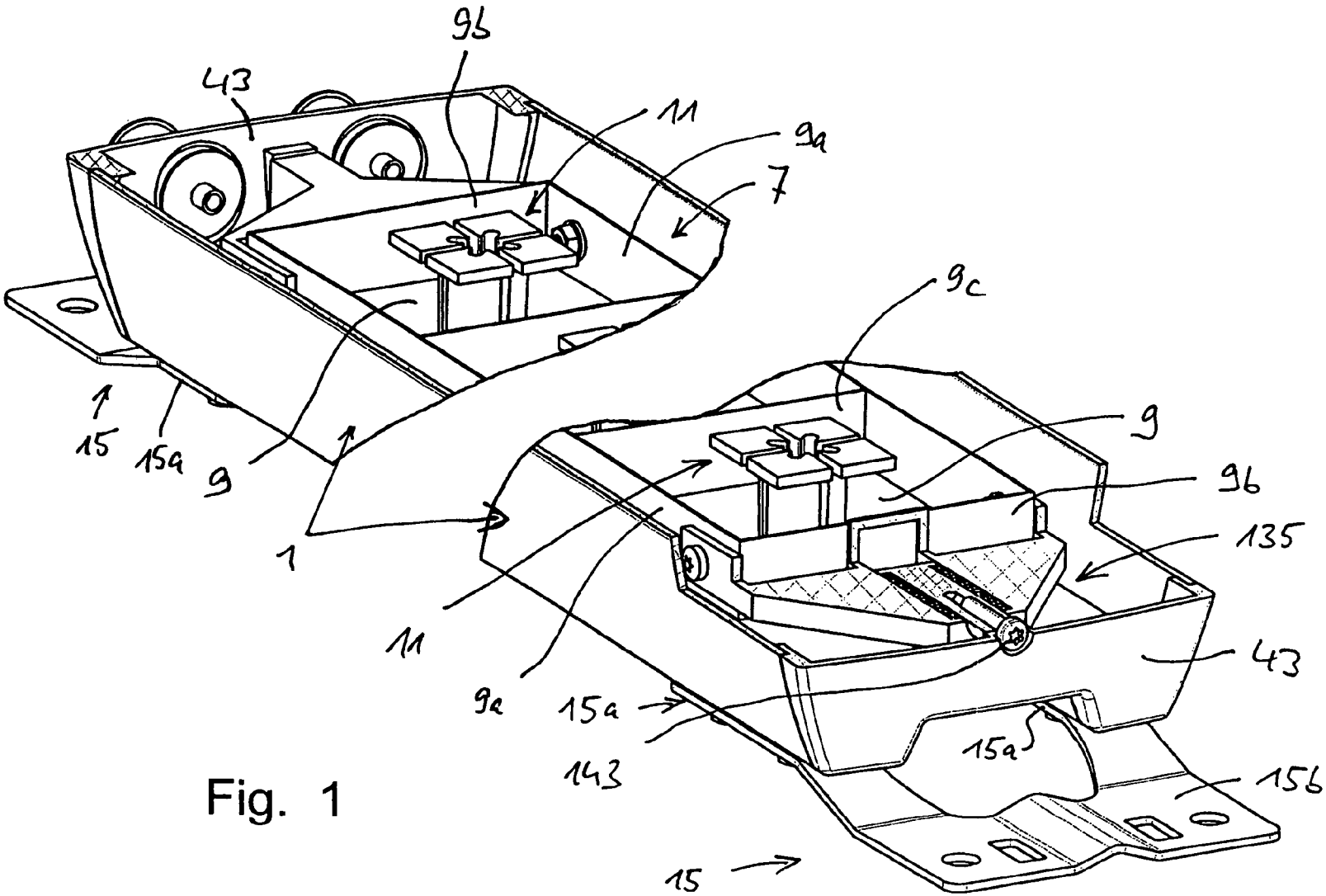
FIG. 1 is a schematic three-dimensional view of an antenna device according to the invention with the upper part of the antenna housing/radome having been partially removed in section.

FIG. 1 is a schematic three-dimensional view of a first embodiment of an antenna device, which is used in particular for frequency ranges of above 2 GHz, for example for so-called wireless WiMAX technology.

For this purpose, the antenna device comprises a housing 1 which will sometimes also be denoted in the following as a radome.

The housing has an upper side 1*a* (FIG. 2) which is usually configured to be slightly spherical or convex at least slightly transversely to the longitudinal extent of the housing, i.e. it bulges at least slightly outwards. The upper side 1*a* of the housing/radome merges, arched, into the side wall portions 1*b*, which also bulge slightly outwards, at two upper and (directed in the radiation direction) outer boundary edges 3.

Seen from the end face, the cross-sectional shape of the housing/radome in the illustrated embodiment is rather trapezoidal, such that the upper side 1*a* of the radome positioned at the top in the direction of radiation has a slightly greater width than the distance between the opposing side wall portions 1*b* in the region of the lower side of the housing/radome.

Figure 2:
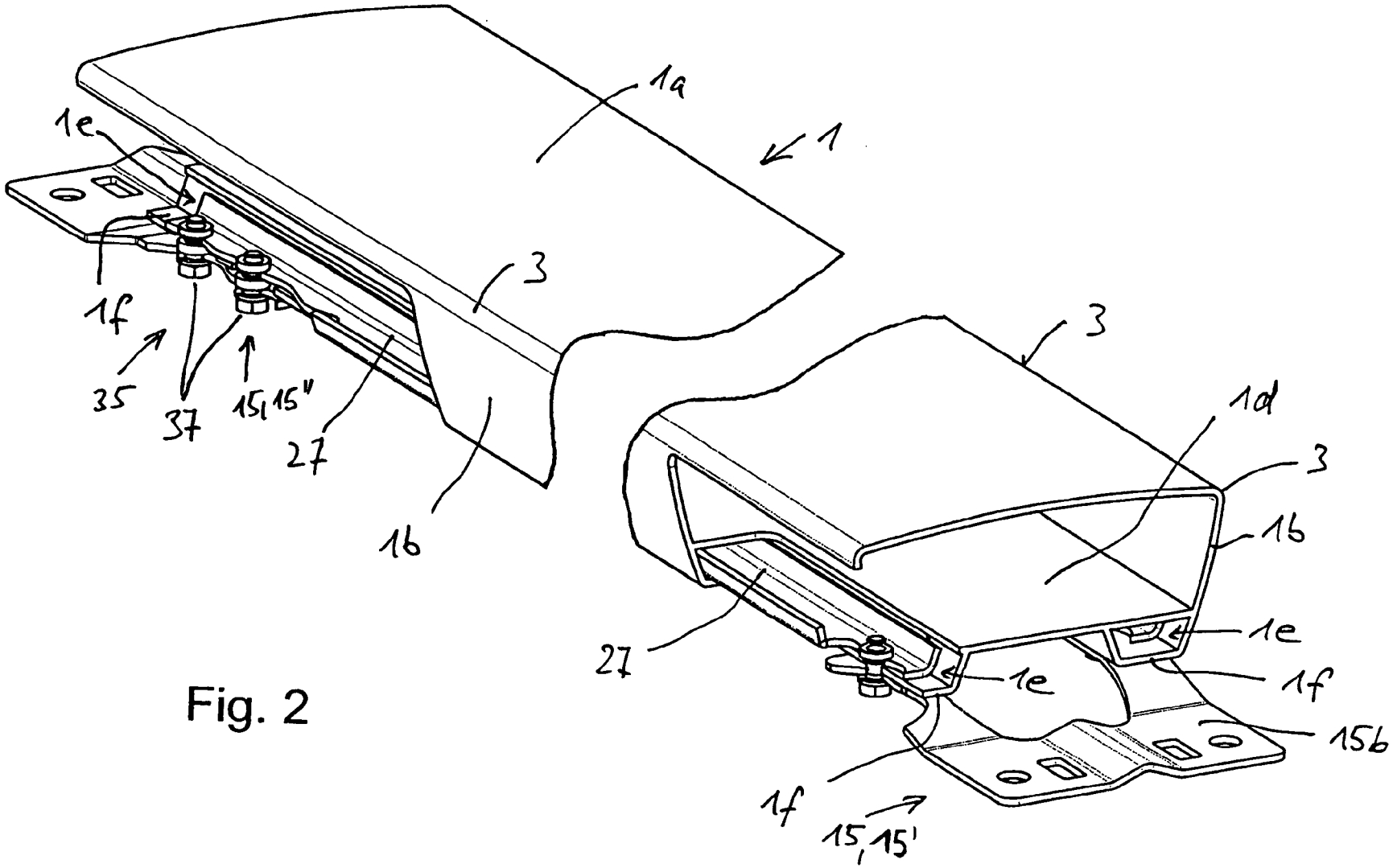
FIG. 2 is a perspective view, similar to that of FIG. 1, of the antenna device where parts of the housing/radome have been partially removed in section, including the end or cover caps opposed at the end face, to illustrate the mounting device.

As can be seen from the partially sectional view according to FIG. 2, the housing/radome 1 has a back wall or a base 1*d* which is planar in the illustrated embodiment. The aforementioned construction is purely an example. The corresponding housing/radome can in principle have any cross-sectional shapes or other shapes, thus for example a straight upper side, even a concavely curved upper side, upper sides or side walls with groove-shaped recesses, etc. There are no restrictions in this respect.

In the illustrated embodiment, two parallel chambers 1*e* are provided adjacent to the two longitudinally running side wall portions 1*b* on the rear side or lower side of the base 1*d* opposite the upper side 1*a*, which chambers 1*e* are basically closed except for the openings, described in the following, for the attachment device, the chambers 1*e* being delimited by a chamber wall if which runs at a distance from the base 1*d* and will sometimes also be called supporting wall 1*g*.

As can also be seen in principle in FIG. 1, the actual antenna device with a reflector 9 which is positioned on the base wall 1*d* or runs parallel at a slight distance to the base wall or back wall 1*d* and terminates at a distance from the opposing end faces of the housing/radome, is in the interior 7 of the housing/radome 1, i.e. between the rearward back wall or base wall 1*d*, the side wall portions 1*b* and the upper side 1*a*.

In the illustrated embodiment, a plurality of radiators or radiator devices 11 is arranged in a mutual spacing in the longitudinal direction of the reflector 9. In the illustrated embodiment, the radiators are dual polarised radiator devices 11 which, when the antenna is mounted vertically, transmit and/or receive in two polarisations which are perpendicular with respect to one another and are oriented at an angle of 45° with respect to the vertical or horizontal. Reference is made, by way of example, to prior publication WO 00/039894 A1 with regard to the construction and mode of operation of the antenna relevant here, it being possible for other types of antenna to also be used in this respect, for example single polarised radiators, dipole squares, crossed dipoles, patch radiators etc. No restrictions are indicated in this respect.

It is mentioned purely by way of completeness that in the illustrated embodiment, the reflector 9 is provided with side boundaries 9*a* and end-face transverse boundaries 9*b* as well as transverse boundaries 9*c* which extend between two longitudinal side boundaries, sitting on the reflector plane or at a short distance to said plane, and which can be provided between two radiators 11.

The mounting device for attaching an antenna of this type, for example to a mast or a housing etc. will be described in the following.

To achieve this, the antenna has a respective mounting device 15 in a mutually offset position on its rear side (i.e. associated with rather the opposite end or end face region of the housing/radome), i.e. it has a first mounting device 15' and a second mounting device 15" which, in plan view, approximates a U-shaped bow, in other words a plate configured in a U-shape in plan view, and two mounting limbs 15*a* connected to the antenna and an attachment portion 15*b* which connects the two mounting limbs transversely with respect to one another and is provided with openings 16 to attach, by means of screws for example, a corresponding antenna to a wall, housing wall or using a mating bow engaging around an antenna mast, in that screws are guided through the openings 16 and are secured with the mating bow, for example using nuts. As a very typical alternative, it is also possible to use so-called tightening straps to carry out the attachment and positioning in a suitable location.

FIGS. 2 and 3 show that for example the right-hand mounting device 15, 15' is rigidly connected to the housing/radome by two screws 21, a hole 25 having been made in the rearwards chamber wall portions 1*f* congruently with a respective hole 23 in the respective mounting limb 15*a* of the mounting device 15. In the illustrated embodiment, located inside the chamber 1*e* is a holding or supporting device 27 which acts as a counter contact member (counter plate) and is also provided with a further hole 29 which extends congruently with the holes 23 and 25. The screw 21 shown in FIGS. 2 and 3 with its outer-lying head 21*a* can then be guided by its associated threaded portion through these three holes 23, 25 and 29 such that it can be screwed into a nut 33 located inside the chamber 1*e*.

The holding and supporting rail 27 acting as a counter plate is likewise U-shaped in cross section (transversely to the longitudinal direction), and thus has side portions and a connecting planar central portion, so that the holding and supporting rail 27 approximately corresponds in cross section to the cross-sectional shape (with slightly smaller dimensions) of the chambers 1*e* and is therefore introduced into said chambers accordingly, resting against and on the wall portions of the chambers 1*e*.

The screw 21 can be tightened as much as required or can be fully tightened. While so doing, the holding and supporting device 27 located inside the chamber 1*e* is screwed and thus braced with the outer mounting limb 15*a*, while receiving in sandwich manner a portion of the supporting wall 1*g* representing the chamber wall 1*f*, which is part of the housing/radome 1 of the antenna, such that a secure and fixed anchorage of the mounting device 15, 15' on the housing/radome 1 is ensured.

Since, moreover, the mentioned holes 23, 25, 29 are only adapted to the size of the threaded shank of the screw 31, it is also impossible for any relative displacement to take place here between mounting limb 15*a* and housing/radome or chamber 1*e* or the holding and supporting device 27.

The illustrated embodiment shows that the holding and supporting device 27 is not only plate-shaped, but extends over almost the entire length of the housing/radome inside the chamber 1*e*, i.e. as far as the opposite end of the chamber on which the opposing second mounting device 15 is mounted.

This second mounting device 15, 15" is provided with a length compensation device 35.

In this case, provided in each mounting limb 15*a* are two holes 23 which are offset in the longitudinal direction of the mounting limb 15*a*, through which a respective corresponding screw 37 can be guided for attachment.

In this arrangement, inner holes 29 are made at the same longitudinal distance to the holes 23 in the holding and supporting device 27, hereinafter also termed holding and supporting rail 27, in order to guide through the additional threaded shank of the screws 37 here as well and to tightly screw an associated nut 33 located inside the chamber 1*e*.

In this embodiment, the threaded shank 37' is surrounded by a spacing sleeve 39 as a screwing-in restricting device 239 which, as the screw 37 is further tightened, restricts the minimum distance by which the mounting limb 15*a* and the holding and supporting rail 27 located inside the chamber can be pressed onto one another. As can also be seen from the sectional illustration, there is provided in the region of the rearwards chamber wall 1*f* not only one hole adapted to the diameter of the threaded shank 37', but in each case two mutually offset slots 37" (which could also be joined to form a common slot 37").

If, in this case, the screws 37 are tightened, the spacer or the spacing sleeve 39 ensures that the clearance between the inside 15"*a*, on the housing, of the mounting limb 15*a* and the side 47', directed towards the rear side, of the holding and supporting device 27 is greater than the thickness of the supporting wall 1*g*, i.e. is greater than the thickness of the chamber wall 1*f*, such that at least a small spacing 41, indicated in FIG. 3, remains between the inside 15"*a* of the mounting limb 15*a* and the outside of the chamber wall 1*f*.

In other words, even when the screws 37 are fully tightened, a free relative displacement of the mounting device 15, 15" with respect to the housing/radome cannot be eliminated.

Since in the event of a change in temperature, the mentioned longitudinal displaceability is only provided in the region of the outer chamber 1*e* at least for one of the two mounting devices with respect to the housing/radome 1, the interior 7 of the housing/radome 1 is fully outwardly sealed by the continuous base wall or back wall 1*d*.

Finally, the end caps 43 shown partially in section in FIG. 1 are then positioned on the opposing end faces, as a result of which the interior 7 of the housing/radome 1 is completely tightly sealed.

The common holding and supporting device 27 in the form of a holding and supporting rail 27 which fixes the two mounting devices 15, i.e. the first and second mounting devices 15' and 15" in their longitudinal spacing can ensure that within an average temperature range, the mentioned screws 37 come to rest in a central region of the preferably slot-shaped recess 37" at least in the case of one mounting device 15" provided with a length compensation device 35, so that a completely straightforward mounting is possible which, in practice, ensures that the desired length expansion of the housing/radome with respect to the mounting attachments or mounting devices 15 is effective within all relevant temperature ranges.

Unlike the illustrated embodiment, the mentioned longitudinally extending channels or chambers 1*e* can also be arranged such that they do not project downwards over the base wall or back wall 1*d*, but are accommodated as separate chambers in the region between the base wall or back wall 1*d* and the upper side 1*a* in the interior 7 of the radome.

The advantage is provided in this case as well that the interior 7 is sealed hermetically against moisture and external influences.

A modification of FIG. 3 is shown in FIG. 3*a*.

In the embodiment according to FIG. 3*a*, an intermediate plate 101*f* is provided which is attached to a wall portion 1*f* of the channels 1*e* by screws 247' using nuts 233. In this arrangement, the screws 247' pass through corresponding holes in the wall portion 1*f* and in the supporting rail or the supporting rail portion 27, 27' and are secured by nuts 233 which rest against the back of the supporting rail 27, 27'.

This intermediate plate 101*f* serves as an anchoring base for mounting the length compensation device 35 using screws 37 which are screwed into a tapped hole 101*g* by their shank 37', passing through slots 37".

This arrangement does not use a spacing sleeve or spacer 39, but a screwing-in restriction device 239 which is formed by the length of the threaded shank 37'. In the illustrated embodiment, the length of the tapped hole including the thickness of the associated mounting limb 15*a* is smaller at this point than the length of the screw thread 37'. In other words, even when the screws 37 are fully tightened in the tapped hole (if this is possible), it is ensured that the lower side of the head of the screws 37 does not rest against the outside of the mounting limb 15*a*, but an at least minimum spacing gap or clearance 41 is formed here, which ensures the free displaceability of the mounting device 15, 15" with respect to the intermediate plate 101*f* and thus with respect to the housing/radome 1. As an alternative or in addition, it would also be possible to use a shortened spacing sleeve 39 which rests on the intermediate plate 101*f*, i.e. indirectly on the radome and maintains and ensures further screwing in of the screws while keeping a minimum distance 41.

Instead of the mentioned spacing sleeve 39, it is also possible to use a so-called shoulder screw 37 which is provided with a shoulder 39 of a relatively large diameter which is greater than the diameter of the screw thread located underneath. This relatively wide shoulder 39 effectively performs the function of the spacing sleeve 39.

To avoid a fixed bracing while cancelling a free adjustability, it is generally appropriate in any embodiment to either use spacers or tightening-restricting devices, which ensure that a free clearance 41 is provided to allow an adjustment.

FIG. 5 shows in a purely schematic manner that the attachment device can be configured not on a channel 1*e* or on a corresponding channel wall 1*f*, but for example also on projections, for example web or wall-shaped projections 1*f'*. A web or wall-shaped projection 1*f'* of this type could project for example vertically from the lower housing or radome wall 1*d* and terminate freely.

In this case, anchoring walls 1*f'* which extend in a web shape and preferably run parallel to the base 1*d* are thus used in order to attach, resting against a side, the holding and supporting rail 27 for example to an opposite side of the mounting device 15 with its attachment portion 15*b*, more specifically again using the described nuts. At one attachment point, the mounting device could, for example, be again attached with differing rigidity and to an offset attachment point, preferably in the region of the opposite end of the antenna device using the slotted recess 37", in which case the use of the mentioned spacers or spacing sleeves 39 ensures that a temperature-induced length expansion is achieved in a reliable and straightforward manner relative to the mounting device 15, 15". Further modifications are possible. It is noted purely for the sake of completeness that in FIG. 5, the corresponding attachment is performed using a mounting limb 15*a* also via a second further web or housing/radome wall 1*f'* positioned on the right-hand side, but not shown in FIG. 5, since the support is always provided in pairs. The second mounting device without compensation in length is constructed accordingly, as described with reference to the other embodiment, without spacing sleeve 39 and without the resulting clearance 41, so that a rigid mounting on the web wall 1*f'* is ensured there.

The further embodiment of the antenna device will be described in the following with reference to FIG. 4.

The antenna device which has been described also has an internal length compensation device 135. This device 135 is necessary in order for the housing/radome 1, made for example of a thermoplastic polymer, to perform a different length expansion, induced by temperature, compared to an antenna supporting and/or reflector device which is accommodated in the internal housing/radome 1 and usually consists of metal or a dielectric which is provided with a metallic (conductive) surface. This can ensure that differing, temperature-induced length expansions of the housing/radome and of the internal antenna supporting structure and in particular of the reflector do not result in damage to any part of the arrangement and in particular do not result in leakiness of the housing.

Provided for this purpose in the illustrated embodiment are at least two internal mounting devices 115, in a mutually offset position in the longitudinal direction of the housing/radome 1, namely a first mounting device 115' which does not have a length compensation device, and a second mounting device 115" which does have a length compensation device. The antenna supporting device, which will sometimes be denoted in the following as an antenna supporting and/or reflector device, is held thereby in the interior of the housing/radome 1.

The first internal mounting device 115, 115' is shown in plan view on the left-hand side of FIGS. 1 and 4. In the illustrated embodiment, said first internal mounting device 115, 115' comprises a substantially triangular mounting body 114' (made for example of plastics material) which merges into two mounting limbs 115*a* which extend in the longitudinal direction of the antenna and are offset transversely thereto and are attached to the longitudinal webs 9*a* of the reflector 9 by screws 118 which are screwed in from outside. Instead of the mounting body 114' shown in the drawings, it would also be possible to use a rigid sheet metal bow or a comparable device. Likewise, the end cap could be configured as being integrated with a corresponding mounting body, such that in other words the end cap is directly provided with a shoulder which projects inside the radome and is used for support and/or attachment to the reflector or to the other supporting device provided inside the chamber. Instead of the mentioned screw attachment for connecting the mounting body 114' to the end cap, it is also possible to use any other suitable attachment device, for example a clip, an inserted pin, rivets, Tox fasteners in the case of lead parts etc. No restrictions are mentioned in this respect.

The mounting body 114' which is triangular in plan view merges opposite the reflector 9 into an extended mounting attachment 119' which is central in the illustrated embodiment and comes to rest next to an end-face end cap 43.

From the outside, it is possible for a screw (similar to the screw 145 on the opposite end cap 43) to be screwed into the mounting device 115, i.e. into an internal thread formed in the mounting attachment 114' via a corresponding hole (not shown in more detail in the figures and similar to the hole 143 in the opposite end cap 43), as a result of which this internal mounting device 115, 115' is rigidly connected to the associated end cap 43 and thus connected on this end of the housing/radome 1 and supported thereon.

The opposite second internal mounting device 115" comprises the mentioned internal length compensation device 135.

The second mounting body 114, 114" is basically of a similar construction and is attached by its two outer mounting limbs 115*a* to the adjoining longitudinal webs 9*a* of the reflector 9 by means of the screws 118 positioned there.

However, in this case the central extension attachment 119" is piston-shaped and is guided in a longitudinally displaceable manner in the mounting body 114" in a longitudinal expansion 121. In the illustrated embodiment, a helical spring 123 is positioned in the region of the piston-shaped extension portion 119. In other words, the piston-shaped extension portion 119" passes through the helical spring 123. The helical spring 123 is supported at its opposing ends in each case on a supporting edge, namely on a supporting edge 119*a* which is configured on the extension attachment 119 remote from the end cap 43, as well as on a supporting edge 114*a* which is closer to the end cap 43 and forms part of the mounting body 114", as a result of which the internal diameter of the longitudinal hole 121 is reduced. In the illustrated embodiment, the helical spring 123 is prestressed.

The extension attachment 119" is also screwed into a threaded seat in the extension attachment 119" using a screw 145 guided through a hole 143 in the associated end cap 43, as a result of which the extension attachment 119" is rigidly connected to the associated end cap 43.

A temperature-induced length expansion can result in the fact that with an increase in temperature, the housing/radome is subjected to a relatively great length expansion with respect to the reflector 9. In this case, the associated end cap 43 would distance itself further from the end-face boundary of the associated reflector, in other words the helical spring 123 would be further compressed, since the extension attachment 119" which can be moved in the form of a slide or rail is moved to the right in the length expansion 121 in the view of FIG. 4. In the event of a reduction in temperature, the reverse effect would take place.

In principle, an internal mounting device of this type with a length compensation device could additionally be used at the opposite end. However, it is sufficient for a device of this type to be provided at at least one end face in order to keep the internal antenna supporting device or generally the reflector device and the radiators positioned thereon in a secure mounting.

Instead of the mentioned helical spring 123, it is possible, however, for completely different spring energy stores 123' to be used (leaf springs, disc springs etc.). Likewise, a helical spring could also be used which is not prestressed, but is pre-expanded if the anchoring and support are reversed.

According to the construction which has been described, the internal length compensation device 135 with the mentioned spring energy store 123' is at least divided into two parts, one part being held by or connected to the antenna supporting and/or reflector device, on the one hand, and the other part being held indirectly by or connected to the housing/radome, in the illustrated embodiment via the end cap 43 positioned on the housing/radome. Both parts, namely the mounting body 114" and the extension attachment 119" which is displaceable, in particular longitudinally displaceable, therein or thereon are configured according to a slide device or other guide device such that they allow a length compensation movement and, in so doing, nevertheless hold the internal supporting parts, in particular the reflector. The spring device which is also provided is primarily used to produce contact forces which are directed onto one another and are introduced onto opposing end caps 43 in order to outwardly seal the housing/radome.

The following description, made with reference to FIGS. 6 and 7, explains that even a one-piece or substantially one-piece internal mounting device 115" with a length compensation device 135 is possible.

For this purpose, it is also feasible, as shown for example with reference to FIGS. 6 and 7 in a schematic plan view, to use yoke springs 124 as the internal mounting device 115" or mounting body 114" which are elastically deformable overall, as can be seen from a comparison between FIGS. 6 and 7. FIGS. 6 and 7 reproduce the position and deformation of the yoke springs 124 which could be produced in the case of differing length expansion values of the housing/radome 1 compared to those inside the antenna supporting and/or reflector device 9. Thus, FIGS. 6 and 7 show the clamp clips in a compressed and stretched state, respectively.

The construction which has been described and uses a spring energy store 123' which produces on the associated end cap 43 a contact force in the direction of the associated housing/radome 1 also ensures that contact forces are introduced onto the two opposing end caps 43 by the mentioned spring energy store 123', by which the two end caps 43 are held and pressed firmly and tightly against the opposing end portions of the channel-shaped or receptacle-shaped housing/radome. For this purpose, the caps 43 preferably have an encircling web wall 43' which can be inserted into and engages behind the housing/radome, it also being possible for an encircling seal to be introduced preferably between the associated shoulder portion of the end cap and the end-face wall boundary 47 of the housing/radome.

The invention therefore describes an antenna device in which the internal construction inside the radome 1 with an internal length compensation device 135 is at least indirectly held and anchored on the housing/radome 1, an external length compensation device 35 also being provided which allows a straightforward mounting of the antenna device, i.e. of the housing/radome, for example on a wall or a mast, etc. Consequently, the housing/radome can perform a differing length expansion primarily induced by temperature without the housing/radome being damaged or destroyed and parts of the antenna located in the interior or parts of the radome being subjected to environmental influences, particularly without moisture being able to penetrate inside the housing/radome, which is highly undesirable.

Both the external mounting devices 15 and the internal mounting devices 115 can be easily provided, for example at three (or more) offset positions. In this case, it would be possible, for example to fit the most remote mounting device in each case with the described internal and external length compensation devices 35, 135 both internally as well as externally, and to provide an external and an internal mounting device 15, 115 merely in between which is configured in each case without a length compensation device. A preferred arrangement is one in which a mounting device is used at the start or at the end without a length compensation device and the subsequent, mutually offset mounting devices are then provided with a corresponding length compensation device, in which case with an increasing distance from the mounting device without a length compensation device, the mounting device used must allow an increasing compensation in length.

The drawings therefore show an embodiment in which at least two chambers are provided on which the attachment device engages. However, if required, more chambers can be provided which preferably run parallel to one another and to which the mounting device is additionally attached.

All suitable materials are considered as material for the housing/radome. It is possible in particular to use coextrudates or electrically neutral fibres. Materials consisting of electrically neutral fibres using wood fibres are also possible. Thermoplastic polymers which have higher thermal expansion coefficients compared to metals are also particularly suitable as raw materials.

The invention claimed is:

1. Antenna device comprising:

a housing/radome, an antenna supporting and/or reflector device provided inside the housing/radome, via which a plurality of radiator devices is held at least indirectly, an internal length compensation device allowing a differing expansion in length of the housing/radome in relation to the antenna supporting and/or reflector device positioned in the interior of the housing/radome, the antenna supporting and/or reflector device is anchored to the housing/radome, at least indirectly at least two mutually offset points, preferably at points offset in the longitudinal direction of the antenna device, by a respective internal mounting device, at least one of the at least two internal mounting devices is provided with the internal length compensation device, the internal length compensation device is at least divided in two or arranged in two parts, one part being rigidly connected to the antenna supporting and/or reflector device and/or being supported thereon and the other part being rigidly connected at least indirectly to the housing/radome and/or being supported thereon, the at least two parts can be displaced, changed in position or deformed relative to one another, in particular can be changed in position relative to one another with respect to their two supporting points while they are jointly deformed, and a spring energy store provided between the at least two relatively displaceable parts of the internal length compensation device.

2. Antenna device according to claim 1, wherein the spring energy store comprises a spring device which is prestressed in compression, in particular a helical spring.

3. Antenna device according to claim 1, wherein the spring energy store comprises a spring device which is prestressed in expansion.

4. Antenna device according to claim 1, wherein both parts of the length compensation device can be adjusted relative to one another in the form of a slide and/or rail.

5. Antenna device according to claim 1, wherein the spring energy store and in particular the spring device, preferably in the form of a helical spring, are supported between two projections, namely on an annular projection which projects radially over the adjusting/extension attachment and on an annular projection which projects radially inwards and is configured on the mounting body.

6. Antenna device according to claim 1, wherein only one internal mounting device is provided with an internal length compensation device.

7. Antenna device according to claim 1, wherein at least two internal mounting devices are provided in a mutually offset position and are each fitted with an internal length compensation device.

8. Antenna device according to claim 1, wherein the antenna supporting and/or reflector device is rigidly connected to the housing/radome, preferably in a central region, and in that a respective further internal mounting device is provided in an offset position with respect to the two opposing end regions of the antenna supporting and/or reflector device and is equipped in each case with an internal length compensation device.

9. Antenna device according to claim 1, wherein at least one and preferably both internal mounting devices are attached to two end face caps or end caps which seal off the housing/radome at the two opposing ends.

10. Antenna device according to claim 9, wherein the two end caps are held and pressed against the respectively open end of the housing/radome under pretension by the at least one provided spring energy store loaded in compression.

11. Antenna device according to claim 1, comprising:

at least two mutually offset external mounting devices for mounting and attaching the housing/radome, an external length compensation device which allows a differing expansion in length of the housing/radome with respect to at least one of the at least two mounting devices for attaching the antenna device, at least one of the two mounting devices is provided with an external length compensation device, for this, the at least one external mounting device comprises a guide device by which the housing/radome can be relatively adjusted with respect to the external mounting device in one direction of the antenna housing/radome at least for a path length, and the external length compensation device with the guide device is constructed such that even when screws are tightened between a portion of the housing/radome and a portion of the external mounting device, there remains a clearance or spacing which allows an unhindered compensation movement between the external mounting device and the housing/radome.

12. Antenna device according to claim 11, wherein the external length compensation device comprises a supporting wall which is connected to the housing/radome or forms a part of the housing/radome and is accommodated in sandwich fashion between a portion of the external mounting device and a holding and supporting device, the aforementioned parts being penetrated preferably by at least one screw and braced against one another and a spacer device also being provided, whereby the minimum distance between the external mounting device and the holding and supporting device in the region of the locking screw corresponds to a value which is greater than the thickness of the associated supporting wall, to which the external length compensation device is attached.

13. Antenna device according to claim 12, wherein the external length compensation device is attached to the supporting wall which is configured as the chamber wall of an additionally provided chamber which is separated from the interior of the housing/radome in which the reflector and/or the radiator device are accommodated, at least two chambers preferably being provided.

14. Antenna device according to claim 12, wherein the supporting wall, which is rigidly connected to the housing/radome, of the external length compensation device is attached in the form of a freely protruding projection, shoulder or web.

15. Antenna device according to claim 11, wherein the external length compensation device comprises a supporting wall which is connected to the housing/radome or forms a part of the housing/radome and into which locking screws can be screwed which cooperate with a screwing-in restriction device, preferably in the form of a screw shank which is longer than the associated depth of the tapped hole and/or in the form of a spacing device and/or in the form of a shoulder screw with a shoulder, such that even when screws are fully tightened in the tapped hole, a minimum distance remains between the external mounting device and the supporting device in the region of the locking screw.

16. Antenna device according to claim 11, wherein provided in the housing/radome, in particular in a portion of the chamber wall separate from the interior of the housing/radome or in a projection, shoulder or web connected to the housing/radome is at least one slotted recess, in the region of which at least one attachment screw is provided which passes through a hole in the external mounting device and a slotted recess in a portion of the chamber wall or in the projection, shoulder or web, as well as through a further hole, congruent with the hole in the external mounting device, in the holding and supporting device and is braced with a rearwards threaded device the screw shank projecting through a spacing sleeve, the axial length of which is greater than the thickness of the associated portion of the chamber wall.

17. Antenna device according to claim 11, wherein the holding and supporting device comprises a holding and supporting rail which, in an offset position, is screwed together with at least one further second external mounting device which is offset with respect to the first external mounting device, by at least one screw connection device.

18. Antenna device according to claim 17, wherein at least the second external mounting device is fitted without an external length compensation device.

19. Antenna device according to claim 11, wherein the at least one further external mounting device is provided with a further external length compensation device.

20. Antenna device according to claim 11, wherein at least n external mounting devices which are offset with respect to one another in one direction, preferably in the longitudinal direction of the antenna device are provided, n being a natural integer greater than two, and in that of the n external mounting devices, at least n−1 external mounting devices are each provided with an external compensation device and preferably the at least one external mounting device provided without an external compensation device is positioned at the start or at the end of the housing/radome.

21. Antenna device according to claim 11, wherein the holding and supporting device, preferably in the form of a holding and supporting rail is accommodated in each case in a separate additional chamber which is divided by a closed housing/radome wall to form the interior of the housing/radome, in which the antenna supporting and/or reflector device is accommodated.

22. Antenna device according to claim 11, wherein the housing/radome consists of a co-extruded material or of electrically neutral fibres or of a thermoplastic polymer, in particular of an unreinforced thermoplastic polymer or of a thermoplastic polymer reinforced with electrically neutral fibres.

23. Antenna device according to claim 11, wherein the housing/radome expands by more than a factor of three compared to the antenna supporting and/or reflector device provided in the interior of the housing/radome, in particular a metal antenna supporting and/or reflector device.

* * * * *